United States Patent [19]

Müller et al.

[11] Patent Number: 5,065,669

[45] Date of Patent: Nov. 19, 1991

[54] DEVICE FOR CONVEYING COLD AND/OR WARM SUPPLY AIR INTO A SPACE

[75] Inventors: Gottfried Müller; Paul Hipp, both of Kolbingen, Fed. Rep. of Germany

[73] Assignee: Schako Metallwarenfabrik, Kolbingen, Fed. Rep. of Germany

[21] Appl. No.: 586,956

[22] Filed: Sep. 24, 1990

[30] Foreign Application Priority Data

Sep. 28, 1989 [DE] Fed. Rep. of Germany ... 8911555[U]

[51] Int. Cl.[5] ..... F24F 13/06

[52] U.S. Cl. ..... 98/40.11; 98/40.12

[58] Field of Search ..... 98/40.01, 40.05, 40.11, 98/40.12, 40.13

[56] References Cited

U.S. PATENT DOCUMENTS 4,955,286 9/1990 Müller et al. ..... 98/40.12 X

FOREIGN PATENT DOCUMENTS 2847017 11/1979 Fed. Rep. of Germany ..... 98/40.11
1298493 3/1987 U.S.S.R. ..... 98/40.01
1533801 11/1978 United Kingdom ..... 98/40.13

OTHER PUBLICATIONS

*Flexiflo Engineering Manual #34,* Universal Diffuser Corp., Tuckahoe, N.Y., 1957, p. 18.

*Primary Examiner*—Harold Joyce
*Attorney, Agent, or Firm*—Bachman & LaPointe

[57] ABSTRACT

In a device for conveying cold and/or warm supply air into a space, comprises a frame body which encloses an outlet opening for the supply air, which outlet opening is covered by a swirl disk. The swirl disk is arranged displaceably in the outlet opening.

8 Claims, 1 Drawing Sheet

DEVICE FOR CONVEYING COLD AND/OR WARM SUPPLY AIR INTO A SPACE

BACKGROUND OF THE INVENTION

The present invention relates to a device for conveying cold and/or warm supply air into a space, comprises a frame body which encloses an outlet opening for the supply air, which outlet opening is covered by a swirl disk which has, for example, slit-shaped outlets.

Such a device is known, for example, as a ceiling swirl outlet. In this device, supply air which has been brought via appropriate supply systems strikes the inside of a swirl disk which is pierced with swirl outlets.

These swirl outlets may, if appropriate, be arranged annularly and be manufactured by punching operations. Wall parts between punched parts are angled relative to the plane so that the air leaving also has a corresponding swirl. The air supply into a space is significantly improved thereby.

The problem continually arises with air delivery that this air delivery should take a different form for certain spaces, heights of spaces and fields of use. In some cases, it is preferred for air to be guided into the space more quickly and directly vertically, while in other cases, cold air for example should rather be guided into the space parallel to the ceiling or horizontally.

In order to solve this problem, devices are also already known such as, for example, swirl disks having angularly alterable wall parts between the punched parts, or having interacting swirl disks which are arranged behind one another but whose design requires relatively expensive structural systems and whose acquisition and fitting can hence hardly be justified any longer for small spaces.

Accordingly, it is the principle object of the present invention to improve and simplify the device of the above-mentioned type in such a way that they may be used even in relatively low spaces without difficulty and are easy to operate.

SUMMARY OF THE INVENTION

The foregoing object is achieved in that the swirl disk of the conveying device is arranged displaceably in the outlet opening.

The frame body of the conveying device is designed such that it has a relatively sharp edge toward the outlet side and adjoining a built-in ring. On the outside and toward the ceiling, this built-in ring has an inclined outer edge such that the whole swirl outlet is also given an esthetic appearance.

Using a spindle, a screw or a similar moving element, the swirl disk is moved along the longitudinal axis of the frame body in the outlet opening. The spindle, screw or similar moving element which is rigidly connected to the swirl disk is seated in a retaining recess, a retaining rail or the like which is situated in the rear region of the frame, facing the ceiling. If the swirl disk is displaced towards the rear of the frame body, the jet of air conveyed strikes the edge of the circumferential built-in ring and the supply air is guided vertically downwards. This setting is selected preferably when warm air is being conveyed.

If cold air is again fed in by the outlet, the swirl disk is pushed forwards by the spindle, the screw or the like until the swirl disk is flush with the circumferential edge of the built-in ring. In this case, the supply air (cold air here) emerges approximately horizontally and this outlet can thus be used both for warm air and cold air.

In addition to manual operation, it is also conceivable for the outlet to be adjusted electrically or pneumatically using a servomotor or alternatively automatically using a thermostat without any external energy.

This swirl outlet according to the invention may be manufactured with different diameters as desired or according to the required quantity of air. By virtue of its enormous induction, this outlet functions very well and may be used without difficulty in relatively low spaces up to a height of approx. 4.50 m.

BRIEF DESCRIPTION OF THE DRAWINGS

Further advantages, features and details of the invention emerge from the following description of a preferred exemplary embodiment, and with reference to the drawing, in which.

DETAILED DESCRIPTION

Figure 1:
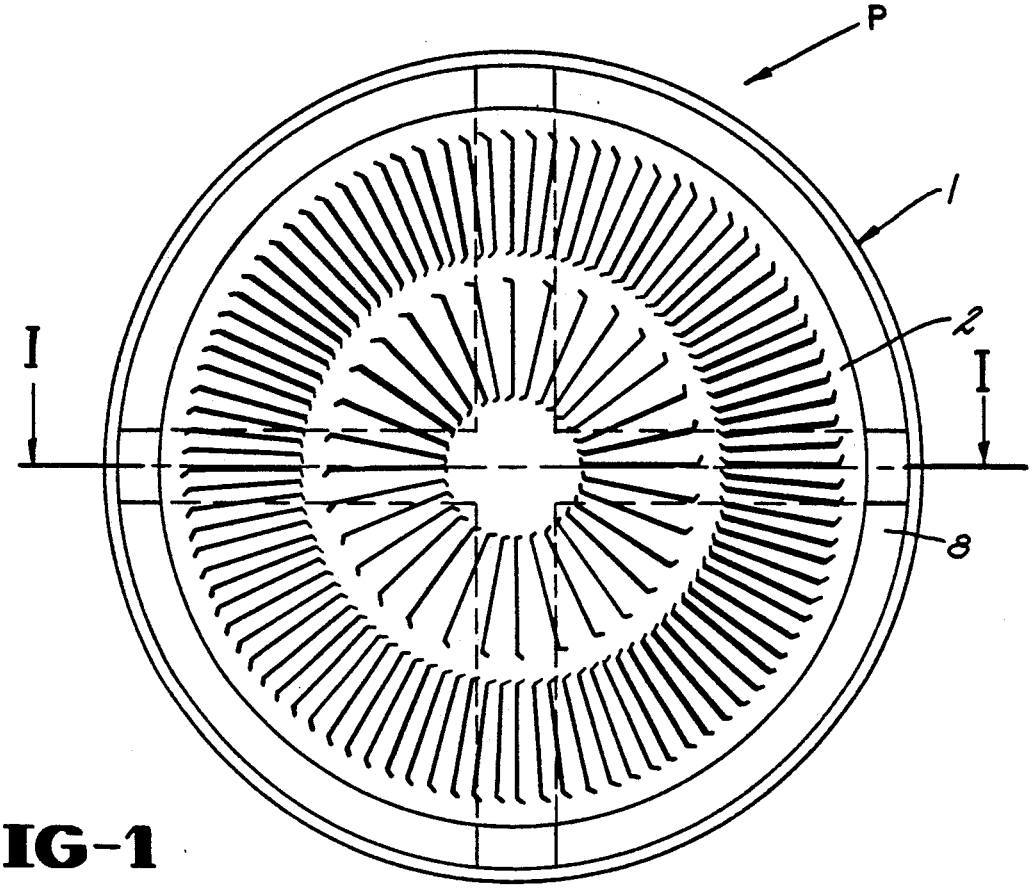
FIG. 1 shows a plan view of a ceiling outlet according to the invention.

According to FIG. 1, a device P for conveying warm and/or cold air has an annular frame body 1 in which a swirl disk 2 is fastened by means of a screw 4, spindle or the like to a retaining recess 8, a retaining strip or the like. The swirl disk 2 may be shifted forwards and backwards by means of the screw 4, spindle or the like in the direction of the longitudinal axis 7 of the frame body 1, the swirl disk 2 remaining in its plane perpendicular to the axis 7.

Figure 2:
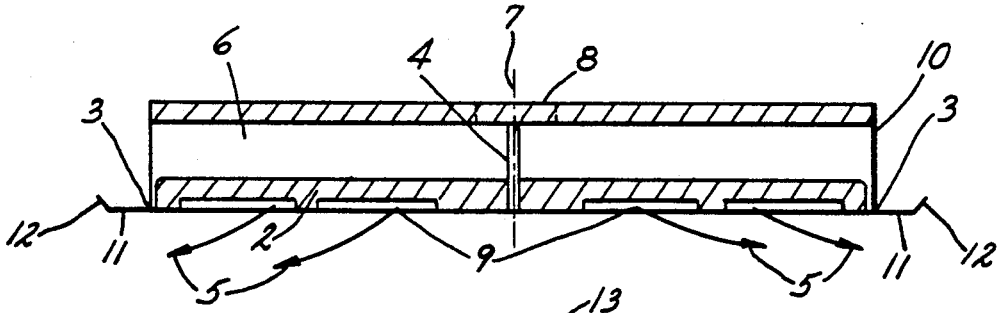
FIG. 2 shows a cross-section through the outlet according to FIG. 1 along a line I-I with the swirl disk drawn forwards.

According to FIG. 2, the frame body 1 consists of an annular connection nozzle 10 connected to an air-conditioning system (not shown in more detail), and of a built-in ring 11 which projects, forming a sharp edge 3, and whose outer edge 12 runs inclined somewhat towards the ceiling, the connection nozzle 10 enclosing an outlet opening 6 in which the swirl disk 2 is arranged displaceably.

The displacement of the swirl disk 2 means that when the swirl disk 2, as shown in FIG. 2, is flush with the edge 3 of the frame body 1, the supply air 5 is distributed in the space, through the punched openings 9 of the swirl disk 2, approximately horizontally.

This setting is selected preferably when conveying cold air.

Figure 3:
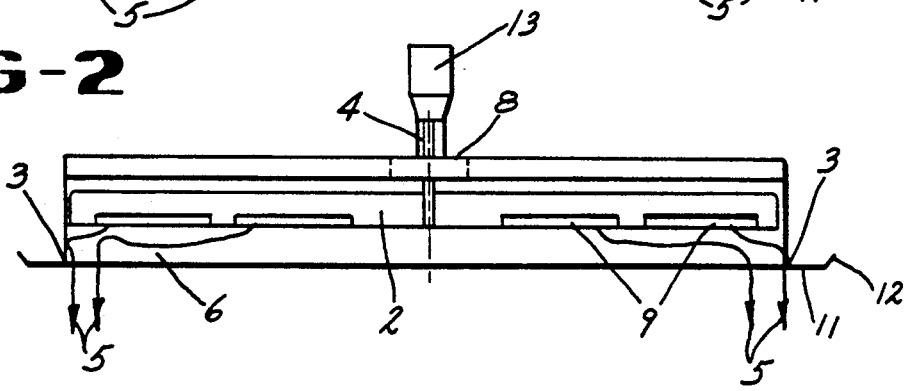
FIG. 3 shows a cross-section according to FIG. 2 with a swirl disk in a changed use position.

If the swirl disk 2 corresponding to FIG. 3 is displaced backwards by means of the screw 4, spindle or the like in the direction of the longitudinal axis 7, jets of air 5 strike the edge 3 of the circumferential frame body 1 and the supply air 5 is guided vertically downwards into the space. This setting of the swirl disk is selected preferably when conveying warm air.

Adjustment of the swirl disk 2 by means of a screw 4, spindle or the like may take place manually. However, it is equally conceivable for this adjustment to be achieved by providing a device 13 such as, for example, an electromotor or a pneumatic motor. A further possibility would be for the swirl disk to be displaced automatically according to the air and warmth conditions of the space by a device 13 which is, for example, controlled by a thermostat or other device for sensing temperature.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A device for conveying air from an outlet opening into a space comprising a frame body positioned about said outlet opening so as to define a conduit downstream of said outlet opening, a swirl disk arranged within said conduit, said swirl disk having aperture means for feeding air passing therethrough such that the air emerges from said swirl disk substantially horizontally and displacement means associated with said swirl disk for displacing said swirl disk within said conduit toward and away from said outlet opening to a retracted and extended position such that when said swirl disk is in its retracted position the air emerging from said swirl disk contacts said conduit and is redirected by said conduit substantially vertically downwards into the space and when said swirl disk is in its extended position the air emerging from said swirl disk emerges substantially horizontally into the space.

2. A device according to claim 1 wherein said frame body comprises a continuous sidewall portion defining said conduit, said sidewall portion having a first end proximate to said outlet opening and a second sharp edge end forming an outlet to said space and a ring projecting radially from said second sharp edge end of said sidewall portion.

3. A device according to claim 2 wherein said frame body further comprises retaining means for supporting said swirl disk within said conduit.

4. A device according to claim 3 wherein said displacement means comprises spindle means secured to said swirl disk and said retaining means.

5. A device according to claim 4 wherein said spindle means screw which is threadably received in said retaining means and movable therein for displacing said disk.

6. A device according to claim 1 wherein said displacement means includes an electric motor.

7. A device to claim 1 wherein said displacement means a pneumatic motor.

8. A device according to claim 2 wherein said ring has an inclined edge inclined toward said outlet opening.

* * * * *